US008682628B2

(12) United States Patent
Bowen et al.

(10) Patent No.: US 8,682,628 B2
(45) Date of Patent: Mar. 25, 2014

(54) MULTIPHASE FLOW IN A WELLBORE AND CONNECTED HYDRAULIC FRACTURE

(75) Inventors: Garfield Bowen, Brightwell-cum-Sotwell (GB); Terry Wayne Stone, Hampshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 193 days.

(21) Appl. No.: 13/034,737

(22) Filed: Feb. 25, 2011

(65) Prior Publication Data

US 2011/0320177 A1 Dec. 29, 2011

Related U.S. Application Data

(60) Provisional application No. 61/358,101, filed on Jun. 24, 2010.

(51) Int. Cl.
*G06G 7/48* (2006.01)
*E21B 49/00* (2006.01)

(52) U.S. Cl.
CPC ..... *E21B 49/00* (2013.01)
USPC ..... 703/10; 702/6

(58) Field of Classification Search
USPC ..... 703/10; 702/6
See application file for complete search history.

(56) References Cited

U.S. PATENT DOCUMENTS 8,204,727 B2 * 6/2012 Dean et al. ..... 703/10
8,392,165 B2 * 3/2013 Craig et al. ..... 703/10
2003/0216898 A1 * 11/2003 Basquet et al. ..... 703/10
2008/0133186 A1 * 6/2008 Li et al. ..... 703/2
2009/0210174 A1 8/2009 Stone et al.
2010/0076738 A1 * 3/2010 Dean et al. ..... 703/7
2010/0250216 A1 9/2010 Narr

OTHER PUBLICATIONS

Cipolla C. L., Lolon E. P., Mayerhofer, M. J., "Reservoir Modeling and Production Evaluation in Shale-Gas Reservoirs," IPTC 13185 presented at the International Petroleum Technology Conference, Doha, Qatar, Dec. 7-9, 2009, pp. 1-15.
Cokar M., Kallos, M. S., Gates I. D., "Reservoir Simulation of Steam Fracturing in Early Cycle Cyclic Steam Stimulation," SPE 129686 presented at the 2010 SPE Improved Oil Recovery Symposium, Tulsa, Oklahoma, USA, Apr. 24-28, 2010, pp. 1-19.
Holmes, J. A., Barkve, T., and Lund, 0., "Application of a Multisegment Well Model to Simulate Flow in Advanced Wells," SPE 50646 presented at the SPE European Petroleum Conference, The Hague, The Netherlands, Oct. 20-22, 1998, pp. 1-11.
Holmes J. A., Byer T., Edwards D. A., Stone T. W., Pallister I., Shaw G., Walsh D., "A Unified Wellbore Model for Reservoir Simulation," SPE 134928 to be presented at the SPE Annual Technical Conference and Exhibition, Florence, Italy, Sep. 19-22, 2010, pp. 1-14.

(Continued)

*Primary Examiner* — Eunhee Kim
(74) *Attorney, Agent, or Firm* — Cuong Lam Nguyen; Rodney Warfford; Brian Pangrle

(57) ABSTRACT

One or more computer-readable media include computer-executable instructions to instruct a computing system to iteratively solve a system of equations that model a wellbore and fracture network in a reservoir where the system of equations includes equations for multiphase flow in a porous medium, equations for multiphase flow between a fracture and a wellbore, and equations for multiphase flow between a formation of a reservoir and a fracture. Various other apparatuses, systems, methods, etc., are also disclosed.

13 Claims, 12 Drawing Sheets

(56) References Cited

OTHER PUBLICATIONS

Huskey W. L., Crawford P. B., "Performance of Petroleum Reservoirs Containing Vertical Fractures in the Matrix," Society of Petroleum Engineers Journal, Jun. 1967, pp. 221-228.
Koehler M., "Productivity of Frac Stimulations in the German Rotliegend: Theoretical Consideration and Practical Results," SPE 94250 presented at the SPE EUROPECTEAGE Annual Conference, Madrid, Spain, Jun. 13-16, 2005, pp. 1-14.
Neylon, K., Reiso, E, Holmes, J. A. and Nesse, 0. B., "Modeling Well Inflow Control with Flow in Both Annulus and Tubing," SPE 118909 presented at the 2009 SPE Reservoir Simulation Symposium, The Woodlands, Texas, USA, Feb. 2-4, 2009, pp. 1-13.
Prats M., "Effect of Vertical Fractures on Reservoir Behavior—Incompressible Fluid Case," SPE 1575-G and Society of Petroleum Engineers Journal, 106-118, Jun. 1961,pp. 105-118.
Stone, T. W., Bennett, J., Law, D.H.-S. and Holmes, J.A., "Thermal Simulation With Multisegment Wells," SPEREE 5 (3):206-218, and SPE 66373 presented at the SPE Reservoir Simulation Symposium, Houston, Texas, Feb. 11-4, 2001, pp. 1-13.
Stone T. W., Naccache P., Neylon K., Edwards D., Damas C. E. P., Rowan D., "Dynamic and Static Thermal Well Flow Control Simulation," SPE 130499 presented at the SPE EUROPEC/EAGE Annual Conference and Exhibition, Barcelona, Spain, Jun. 14-17, 2010, pp. 1-9.
Van Poollen H. K., "Productivity vs Permeability Damage in Hydraulically Produced Fractures," Drill. and Prod. Prac., API, 103, 1957, pp. 103-110.
Van Poollen H. K., Tinsley J. M., Saunders C. D., "Hydraulic Fracturing: Fracture Flow Capacity vs Well Productivity," Trans., AIME, vol. 213, 91, 1958, pp. 91-95.
Downey, R., "e-Field: Efficient, Intelligent Operations for Field Development," TIPRO's 61st Annual Convention, Austin, TX, Feb. 28-Mar. 2, 2007 (attached as Rich Downey Presentation, SLB—included for background and GUIs).
Schlumberger, 2009. ECLIPSE Technical Reference Manual, 2009, Chapter 16—Dual Porosity, Chapter 42—Multi-segment Wells, and Chapter 76—Well Inflow Performance, 150Pages.
U.S. Appl. No. 61/162,962, filed on Mar. 24, 2009.

* cited by examiner

Darcy or Fracture Segment Equations 500

Darcy Phase Molar Flow Rate 510

$$G_{ph} = C_{darcy} \cdot K_{frac} \cdot A \cdot K_{r_{ph}} / \mu_{ph} \cdot \rho_{ph} \cdot \delta P_{ph} / L_{seg}$$

Standard Formulation Component Conservation Equations 520

$\sum_{ph} m_{c,ph}$ Sum of product of Darcy phase molar flow rate ($G_{ph}$) and upstream mole fraction of component $c$ in phase $ph$ ($x_{c,ph,\ upstream}$)

$\sum_{k} m_{c,k}$ Sum of flow of component $c$ in connection $k$ from the formation $\sum_{s,ph} m_{c,s,ph}$ Sum of $m_{c,ph}$ in all inlet segments $s$ $\frac{\Delta M_c}{\Delta t} = \frac{M_c^{t+\Delta t} - M_c^t}{\Delta t}$ Incremental change of total amount of component $c$ in segment for time interval $\Delta t$ $$-\sum_{ph} m_{c,ph} + \sum_{k} m_{c,k} + \sum_{s,ph} m_{c,s,ph} - \frac{M_c^{t+\Delta t} - M_c^t}{\Delta t} = 0,$$

$$c \in all\ components$$

Fig. 5

Diagonal Formulation Component Conservation Equations 530

$M_T^{pipe}$ is the total molar flow rate in the segment pipe $M_{T,s}$ total molar flow rate in all connecting segments $s$ Global Mole Fractions (Z) / Residual Equation 534

$$Z_i, i \in components$$

$$Z_c = \frac{-\sum_{ph}^{inj} m_{c,ph} + \sum_{ph,s}^{prod} m_{c,ph,s} + \sum_{k}^{prod} m_{c,k} + \frac{M_c^t}{\Delta t}}{-\sum_{c,ph}^{inj} m_{c,ph} + \sum_{c,ph,s}^{prod} m_{c,ph,s} + \sum_{c,k}^{prod} m_{c,k} + \frac{M_T^t}{\Delta t}}$$

Total Molar Balance 538

$$m_T^{pipe} - \sum_s m_{T,s} - \sum_k \sum_c m_{c,k} + \frac{1}{\Delta t} \sum_c \Delta M_c = R_T$$

Fig. 6

Production (Fracture-to-Well) 710
(e.g., for Fracture-Wellbore Segments)
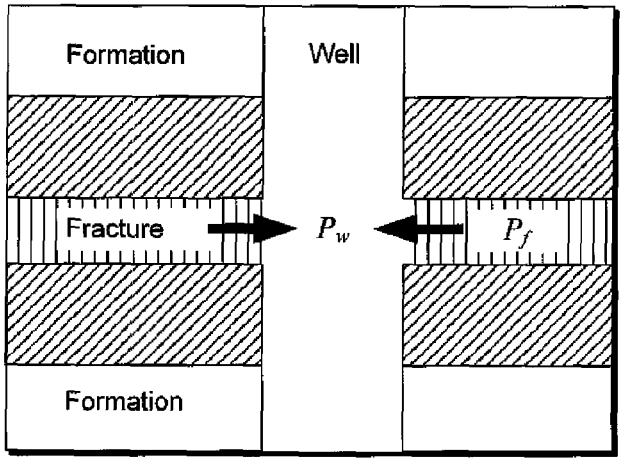
$$P_f > P_w$$
$$q_{ph,fw} = T_{fw}\left(\frac{k_{r\,ph,f}}{\mu_{ph,f}}\right)\left(P_f - P_w - H_{fw}\right)$$
Injection (Well-to-Fracture) 720
(e.g., for Fracture-Wellbore Segments)
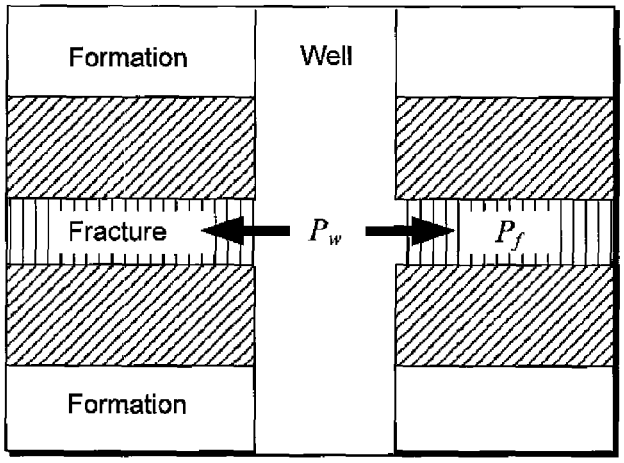
$$P_w > P_f$$
$$q_{ph,fw} = T_{fw} S_{ph,w} \sum_{ph}\left(\frac{k_{r\,ph,f}}{\mu_{ph,f}}\right)\left(P_f - P_w - H_{fw}\right)$$
Fig. 7

Production (Formation-to-Fracture) 810
(e.g., Formation Connection Equations)
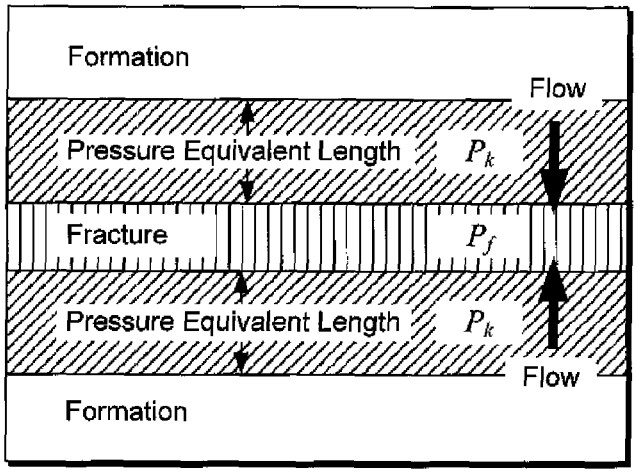
$P_k > P_f$
$$q_{ph,k} = T_{fk}\left(\frac{k_{r\,ph,k}}{\mu_{ph,k}}\right)\left(P_k - P_f - H_{fk}\right)$$
Injection (Fracture-to-Formation) 820
(e.g., Formation Connection Equations)
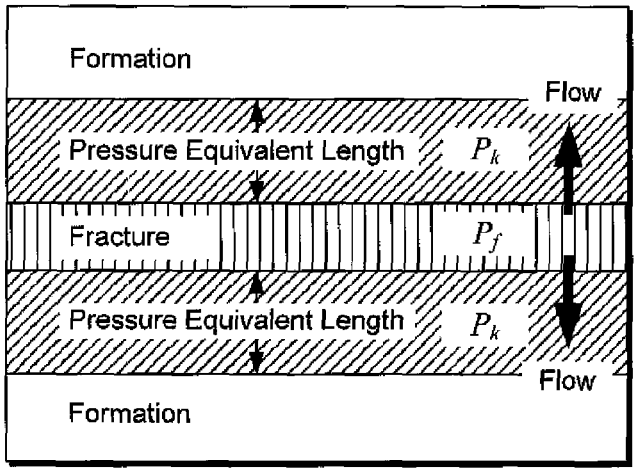
$P_f > P_k$
$$q_{ph,k} = T_{fk} S_{ph,f} \sum_{ph}\left(\frac{k_{r\,ph,k}}{\mu_{ph,k}}\right)\left(P_k - P_f - H_{fk}\right)$$
Fig. 8

MULTIPHASE FLOW IN A WELLBORE AND CONNECTED HYDRAULIC FRACTURE

RELATED APPLICATIONS

This application claims the benefit of U.S. Provisional Application having Ser. No. 61/358,101 entitled "Multiphase Flow in a Wellbore and Connected Hydraulic Fracture," filed Jun. 24, 2010, which is incorporated by reference herein.

BACKGROUND

Fractures can provide flow paths from a reservoir to a wellbore or a wellbore to a reservoir. In general, permeability in a fracture is greater than in the material surrounding a fracture. Fractures may be natural or artificial. An artificial fracture may be made, for example, by injecting fluid into a wellbore to increase pressure in the well bore beyond a level sufficient to cause fracture of a surrounding formation or formations. The pressure required to fracture a formation may be estimated on a fracture gradient for that formation (e.g., kPa/m or psi/foot). Other techniques to make fractures can involve combustion or explosion (e.g., combustible gases, explosives, etc.). As to hydraulic fractures, injected fluid (water or other) aims to open and extend a fracture from a wellbore and may further aim to transport proppant throughout a fracture. A proppant is typically sand, ceramic or other particles that can hold fractures open, at least to some extent, after a hydraulic fracturing treatment. A proppant thereby aims to preserve paths for flow, whether from a wellbore to a reservoir or vice versa. Artificial fractures may be oriented in any of a variety of directions, which may be to some extent controllable (e.g., based on wellbore direction, size and location; based on pressure and pressure gradient with respect to time; based on injected material; based on use of a proppant; etc.).

Hydraulic fracturing is particularly useful for production of natural gas and may be essential for production of so-called unconventional natural gas. Worldwide reserves of unconventional natural gas are largely undeveloped resources. Reasons for lack of production from such reserves include an industry focus on producing gas from conventional reserves and difficulty of producing gas from unconventional gas reserves. Unconventional gas reserves are typically characterized by low permeability where gas has difficulty flowing into wells without some type of assistive efforts. For example, one of the principal ways to assist gas flow from an unconventional reservoir involves hydraulic fracturing to increase overall permeability of the reservoir.

Production of a resource from a reservoir typically commences with data gathering followed by modeling to simulate the reservoir and its production potential. A conventional simulator configured to solve a reservoir model may rely on information obtained through a well model where the well model is solved in a manner largely independent from the reservoir model. Where fractures are of interest, they are typically introduced into a reservoir model via finely spaced grids to account for the relatively small fracture dimensions and thereby generate a so-called reservoir-fracture model.

Various techniques described herein pertain to modeling of fractures, in particular, multiphase flow to, or from, a fracture. Various techniques described herein optionally allow for introducing fractures into a well model to create a so-called well-fracture model. For situations that call for reservoir modeling, a well-fracture model may be solved in a manner relatively independent of a reservoir model, which can alleviate a need for modeling fractures with finely spaced grids in a conventional reservoir-fracture model. In turn, a well-fracture model and reservoir model approach may decrease computational requirements when compared to a conventional well model and reservoir-fracture model approach.

SUMMARY

One or more computer-readable media include computer-executable instructions to instruct a computing system to iteratively solve a system of equations that model a wellbore and fracture network in a reservoir where the system of equations includes equations for multiphase flow in a porous medium, equations for multiphase flow between a fracture and a wellbore, and equations for multiphase flow between a formation of a reservoir and a fracture. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 5 illustrates examples of Darcy segment equations in a "standard" formulation;

FIG. 6 illustrates examples of Darcy segment equations in a "diagonal" formulation (e.g., with respect to the Jacobian);

FIG. 7 illustrates examples of fracture-to-well and well-to-fracture equations;

FIG. 8 illustrates examples of formation-to-fracture and fracture-to-formation equations;

DETAILED DESCRIPTION

Figure 1:
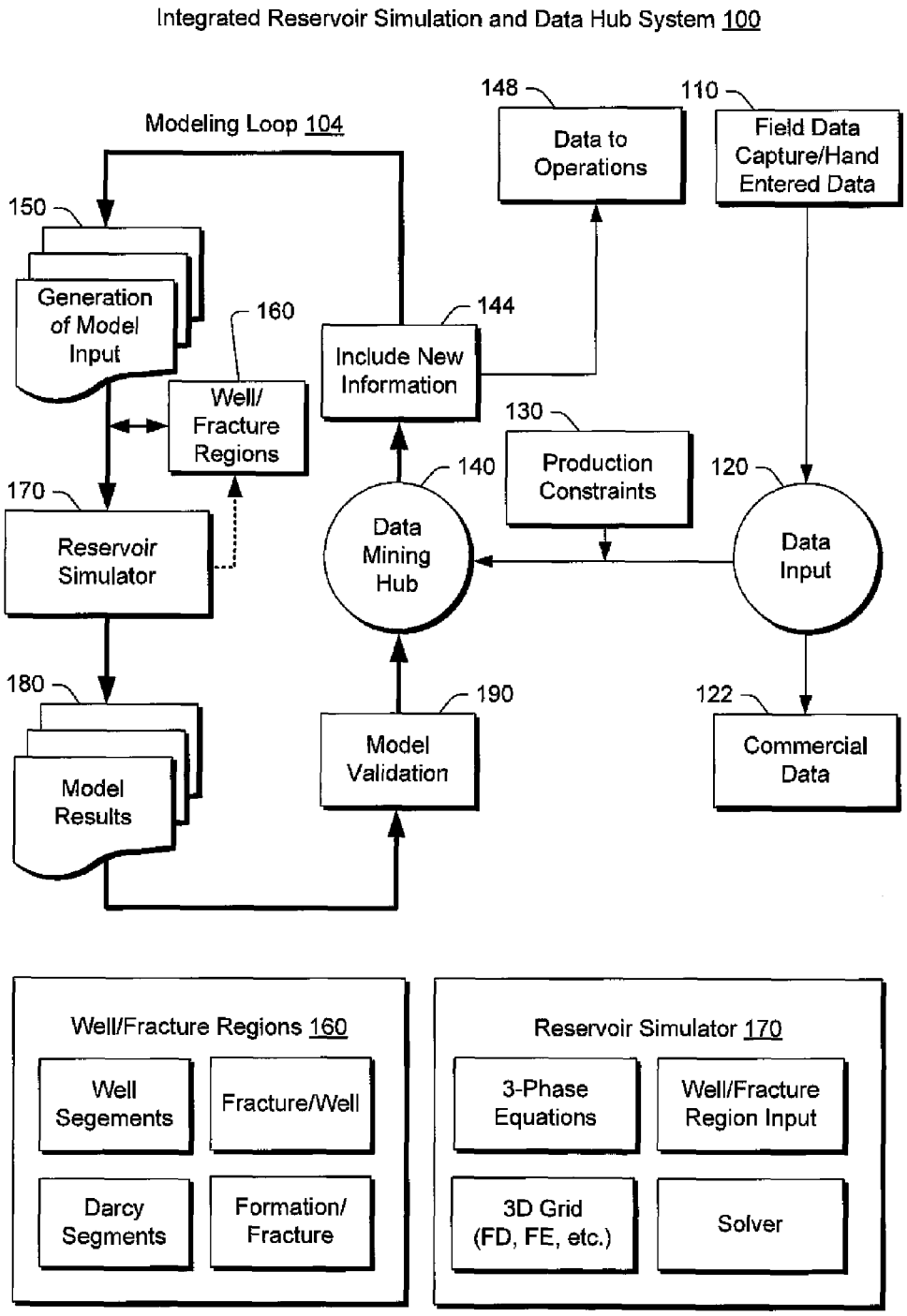
FIG. 1 illustrates an example modeling system that includes a reservoir simulator, a data mining hub and a well-fracture module.

The following description includes the best mode presently contemplated for practicing the described implementations.

This description is not to be taken in a limiting sense, but rather is made merely for the purpose of describing the general principles of the implementations. The scope of the described implementations should be ascertained with reference to the issued claims.

As described herein, various types of models can be employed to understand flow to or from a reservoir. A well model may be defined using segments and associated equations for flow to or from a reservoir while a reservoir model may be defined using grid cells that account for various geophysical features (e.g., faults, horizons, etc.). While various examples described herein pertain to approaches that include use of a well model and a reservoir model, a well model that accounts for one or more fractures (e.g., a well-fracture model), may be a standalone model and implemented, for example, to understand well fluid dynamics (e.g., without implementation of a reservoir model). As described herein, a well-fracture model can include three sets of equations formulated to represent multiphase flow of fluids: (i) in a well, (ii) flowing to and from the well to a hydraulic fracture connected to the well, and (iii) in the hydraulic fracture itself. Various trials demonstrate that such a system of equations can be solved simultaneously to convergence.

Conventional approaches to well modeling often rely on segments where each segment may be defined by a "pipe" and a node. A network of segments can represent wellbore paths for one or more wells. Sources or sinks may be "connected" to the segments, for example, consider a reservoir as a source or sink. Various conventional well models may include connections to a grid cell of a reservoir model.

Conventional approaches to reservoir modeling typically rely on three-dimensional grids that can be iterated over time (e.g., to provide a four-dimensional model). A reservoir may span hundreds of square kilometers and be located kilometers in depth. The expansive nature of a typical reservoir brings various types of physical phenomena into play. Such phenomena may exhibit macroscale, microscale or a combination of macro- and microscale behavior. However, attempts to capture microscale phenomena via increased reservoir grid density or grid densities causes an increase in computational and other resource requirements. For example, increasing two-dimensional grid density by decreasing grid block spacing from 10 meters by 10 meters to 5 meters by 5 meters will increase computational requirements significantly (e.g., a four-fold increase). Accordingly, a tradeoff often exists between modeling microscale features and maintaining reasonable resource requirements.

Conventional approaches for simulating a reservoir with hydraulic fractures model the hydraulic fractures with grid blocks that approximate the fracture geometry. That is, grid blocks are introduced with dimensions that are roughly the fracture thickness, fracture height and fracture length. Fractures are often less than an inch thick (e.g., a couple centimeters), which means that these grid blocks can be significantly smaller in thickness than surrounding grid cells. This, in turn, can lead to inaccuracies in the simulation, instabilities and small timesteps. As mentioned, a reservoir model that includes finely spaced grid blocks that account for fractures may be referred to as a reservoir-fracture model.

As described herein, various techniques allow for calculation of flow in one or more hydraulic fractures connected to a well or wells. As described with respect to various examples, one or more fractures may be modeled as part of a well model or alternatively as part of a reservoir model. Where one or more fractures are modeled as part of a well model (e.g., a well-fracture model), a need to explicitly model a fracture with reservoir model grid cells that have fracture dimensions can be alleviated (e.g., a reservoir-fracture model).

As described herein, an approach may optionally include a reservoir-fracture model that models one or more fractures as part of a reservoir model. In such an approach, the reservoir-fracture model may include formulations of equations that readily allow for coupling to a well model or introducing output to a well model. While such an alternative approach may place some demands on grid size, it may beneficially provide solutions that accommodate a well model. Further, such an alternative approach may be used to benchmark or otherwise assess performance of a well-fracture model.

As to modeling one or more fractures as part of a well model, such an approach can account for flow in hydraulic or other fractures and in wells to which they are connected and highly linked. For example, a pressure profile calculated in and around fractures often shows that the pressure drop in the fractures is similar to pressure drops encountered in wells and very different from that in a surrounding or neighboring formation. A modeling approach that models one or more fractures as part of a well model can involve solving a set of well equations and a set of fracture equations together, independently of a set of reservoir grid cell equations (e.g., for each nonlinear iteration of a combined system of reservoir, well and fracture equations). From a reservoir grid solution viewpoint, such an approach has the effect of solving a reservoir system given a locally converged solution of a well-fracture system.

As to modeling one or more fractures as part of a reservoir model, such an approach may involve representing a fracture as part of the reservoir grid (e.g., a reservoir-fracture model) where a simulator solves conservation equations for the reservoir and fracture simultaneously. In such an approach, a well model may be solved for one or more wells where the solution is used to initialize or update reservoir and fracture unknowns. Where appropriate, a user may be provided with an option to select an approach or options to select multiple approaches to determine whether results warrant one approach over another.

As described herein, in various examples, equations are formulated that account for multiphase flow in a wellbore, multiphase flow from a wellbore to a fracture and vice versa, and multiphase flow in a fracture. Trials demonstrated that a system of such equations could be solved simultaneously to convergence. Accordingly, a solution can be provided for a well model that accounts for fractures (e.g., a well-fracture model). In turn, a solution from a well-fracture model can be provided to initialize or update a reservoir model. Such an approach can alleviate a need to represent fractures as part of a reservoir grid model. Alternatively, where a reservoir grid model includes fractures, a solution from a well-fracture model may provide for superior initialization or updating of unknowns of a reservoir-fracture model or accuracy of a coupled system.

As described herein, a well model or a well-fracture model may be considered a component of a reservoir simulator. Such a module can provide source and sink terms that control progress of a reservoir simulation. In general, a well model acts to determine flow contributions from any connecting reservoir grid cells (e.g., while a well operates under any of a variety of possible control modes). In practice, well model calculations (e.g., oil, water and gas flow rates, bottom hole and tubing head pressures) may be compared with measured values to validate a simulation model of the reservoir. As described herein, a well-fracture model may be used similarly. Overall accuracy of a simulation is typically determined by both accuracy of flow calculation in a reservoir grid and that of a well model. By providing for formulations of equations that allow for a well-fracture model, overall accuracy may be enhanced. Further, as described herein, a field management component may allow for interactions between a solver and field operations such that solutions provided by a solver (or simulator) can be implemented or relied on in the field (e.g., via direct control of equipment, parameter setting, decision making, etc.).

A well model or well-fracture model may include so-called segments and nodes. A multisegment well model treats a well as a network of nodes and "pipes". A segment consists of a node and a pipe connecting it to a neighboring segment's node (e.g., towards a wellhead). Segments representing perforated lengths of the well may contain one or more well-to-reservoir grid cell connections. Other segments such as those representing unperforated lengths of tubing or specific devices, may contain no well-to-reservoir grid cell connections. As described herein, for a well-fracture model, a segment can include well-to-fracture connections and a fracture can include a fracture-to-reservoir grid cell connection or connections.

As described herein, for flow in a fracture, a segment may be associated with equations to model multiphase fluid flow in a porous medium. For example, such equations may describe a Darcy flow model for each phase flow (e.g., a Darcy flow model for phase pressure drop with additional independent variables for each phase molar rate).

As described herein, in various examples, a system that models multiphase flow in a wellbore and connected fracture includes: a well model to calculate both multiphase flow of fluids (i) in the well, (ii) flowing to and from the well to a fracture connected to this well, and (iii) in the fracture itself. In such a system, items (ii) and (iii) may rely on particular types of segments for inclusion in a multisegment well model. Specifically, item (ii) may use a segment that calculates both injecting and producing well inflow performance relations (e.g., a segment that solves equations that describe multiphase fluid flow entering into and exiting out of a wellbore) and item (iii) may use a segment that solves equations that are normally used to model multiphase fluid flow in a porous medium (e.g., equations that can describe a Darcy flow model for each phase flow).

As described herein, a solution technique can include solving a system of non-linear equations for each well, with associated fractures, independently. A solution to such a well-fracture system can, in turn, be a component of an overall reservoir non-linear solution procedure. For example, as described herein, an overall reservoir solution procedure may utilize a converged solution of each individual well and any associated fracture(s).

FIG. 1 shows an integrated reservoir simulation and data hub system 100. The system 100 includes a modeling loop 104 composed of various modules configured to receive and generate information. In a typical operational process, the system 100 receives, at a field data block 110, field data about a reservoir, which may be captured electronically via one or more data acquisition techniques, gathered "by hand" through observation or reporting, etc. The field data block 110 transmits the received data to a data input 120 configured to input data to the modeling loop 104. The data input 120 may also provide some of the received field data to a commercial data block 122 (e.g., for any of a variety of commercial purposes such as financial modeling).

The system 100 includes a production constraints block 130, which may provide information, for example, related to production equipment (e.g., pumps, piping, operational energy costs, etc.). The modeling loop 104 receives information via a data mining hub 140. As noted this information can include data from the data input 120 as well as information from the production constraints block 130. The data mining hub 140 may rely at least in part on a commercially available package or set of modules that execute on one or more computing devices. For example, a commercially available package marketed as the DECIDE!® oil and gas workflow automation, data mining and analysis software (Schlumberger Limited, Houston, Tex.) may be used to provide at least some of the functionality of the data mining hub 140.

The DECIDE!® software provides for data mining and data analysis (e.g., statistical techniques, neural networks, etc.). A particular feature of the DECIDE!® software, referred to as Self-Organizing Maps (SOM), can assist in model development, for example, to enhance reservoir simulation efforts. The DECIDE!® software further includes monitoring and surveillance features that, for example, can assist with data conditioning, well performance and underperformance, liquid loading detection, drawdown detection and well downtime detection. Yet further, the DECIDE!® software includes various graphical user interface modules that allow for presentation of results (e.g., graphs and alarms). While a particular commercial software product is mentioned with respect to various data hub features, as discussed herein, a system need not include all such features to implement various techniques.

Referring again to the modeling loop 104 of FIG. 1, the data mining hub 140 acts to include new information per block 144; noting that some or all of such data may be transmitted to a data to operations block 148 (e.g., for use in the field, etc.). The loop 104 relies on the new information of block 144 to generate model input in a generation block 150. For example, the generation block 150 may adjust one or more parameters of a mathematical model of a reservoir (e.g., optionally including additional geological structure) based at least in part on the new information.

In the system 100, a well and/or fracture region block 160 may provide input to the reservoir simulator along with the model input per the block 150. The reservoir simulator 170 may rely at least in part on a commercially available package or set of modules that execute on one or more computing devices. For example, a commercially available package marketed as the ECLIPSE® reservoir engineering software (Schlumberger Limited, Houston, Tex.) may be used to provide at least some of the functionality of the reservoir simulator 170.

The ECLIPSE® software relies on a finite difference technique, which is a numerical technique that discretizes a physical space into blocks defined by a multidimensional grid. Numerical techniques (e.g., finite difference, finite element, etc.) typically use transforms or mappings to map a physical space to a computational or model space, for example, to facilitate computing. Numerical techniques may include equations for heat transfer, mass transfer, phase change, etc. Some techniques rely on overlaid or staggered grids or blocks to describe variables, which may be interrelated. While the finite difference is mentioned, a finite element approach may include a finite difference approach for time (e.g., to iterate forward or backward in time). As shown in FIG. 1, the reservoir simulator 170 includes equations to describe 3-phase behavior (e.g., liquid, gas, gas in solution), well and/or fracture region input, a 3D grid feature to discretize a physical space and a solver to solve models.

As to the well/fracture regions block 160, depending on the approach selected or implemented, the block 160 may provide a well model, a well-fracture model or both types of models and include a solver that acts to solve a well model, a well-fracture model or both types of models. As indicated a sub-loop can exist between the reservoir simulator 170 and the well/fracture block 160. As indicated in FIG. 1, the well/fracture block 160 may include features for well segments, Darcy segments, fracture/well connections and formation/fracture connections.

As shown in FIG. 1, the reservoir simulator 170 provides results 180 based on at least in part on a reservoir model. Per a validation block 190, the results 180 may be validated, for example, by comparison to acquired physical data for the reservoir, wells, fractures, etc. The loop 104 may continue iteratively as new data is introduced via the data mining hub 140.

Figure 2:
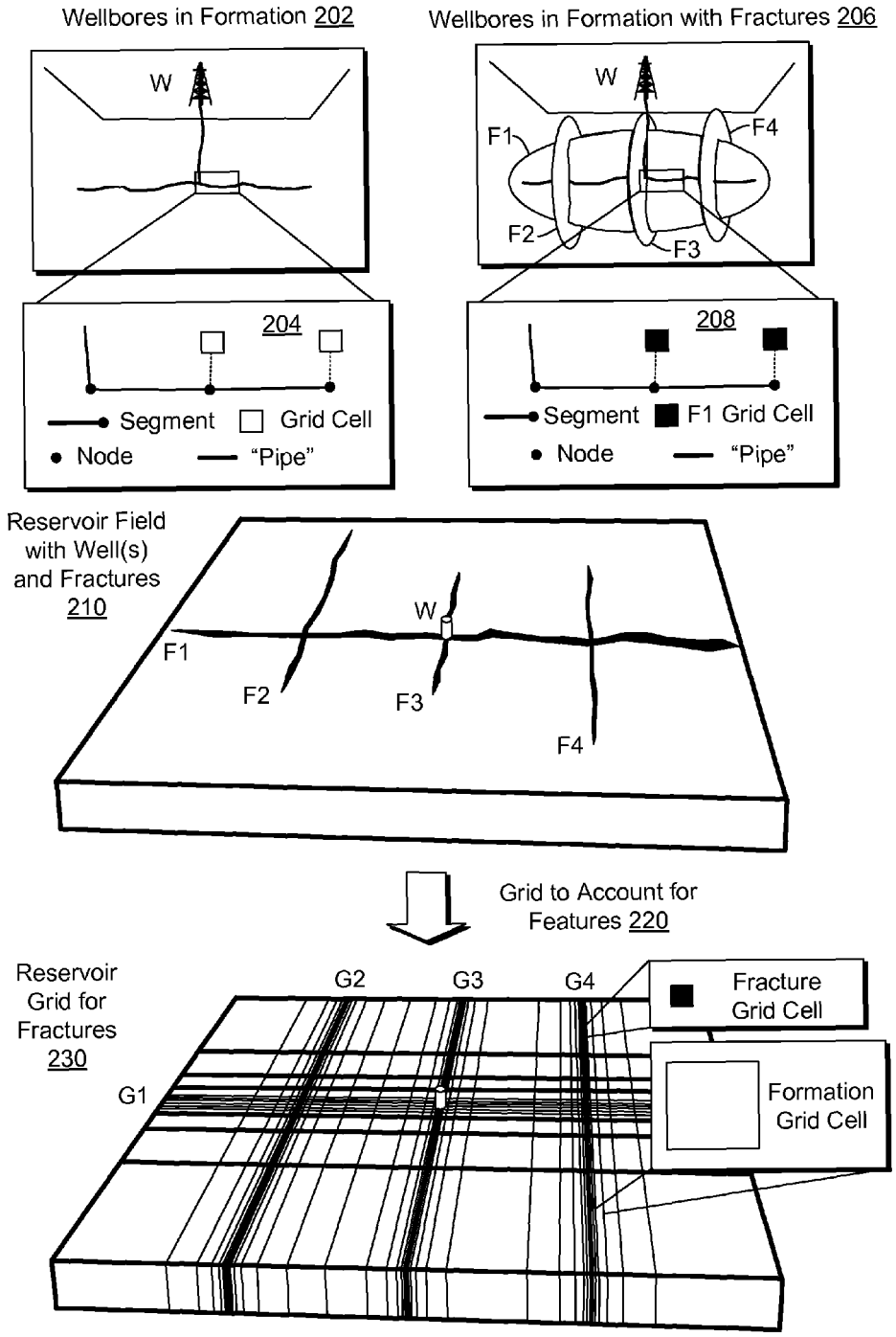
FIG. 2 illustrates an example of a reservoir field with a well and fractures and a corresponding grid for a reservoir model that accounts for the fractures (e.g., a reservoir-fracture model)

FIG. 2 shows an example of a well W with wellbores in a formation 202 and an example of the well W with wellbores in the formation with fractures F1, F2, F3 and F4 206. The wellbores in the formation 202 may be modeled using segments (e.g., a node and "pipe") where each segment can include a connection to a grid cell of a reservoir model. An example of a small portion of a segment network 204 shows segments where a node can have a connection to a grid cell or grid block. As shown in the segment network 204, a node may be a juncture for two or more pipes. The wellbores in the formation with fractures 206 raises some questions as to how to model flow to or from a fracture to a wellbore as well as what type of segment, connection or segment and connection should be established between a fracture and a formation. An example of a small portion of a network 208 shows specialized grid cells (or blocks) that account for physical aspects of a fracture. As explained below, such specialized grid cells can introduce computation demands that can require additional resources (e.g., computational, storage, etc.) and that may increase computation times.

In FIG. 2, a reservoir field 210 is shown that includes one or more wells W and fractures F1, F2, F3 and F4. As mentioned, where an approach models fractures as part of a reservoir grid model, grid cells must be introduced to account for the fracture features of the reservoir field 210. In the example of FIG. 2, gridding 220 accounts for fracture features and other features to generate a reservoir grid. In FIG. 2, the grid 230 is shown as conforming to a Cartesian coordinate system where grid lines extend along each coordinate direction. As such, finely spaced grid regions G1, G2, G3 and G4 that accommodate physical dimensions of the fractures F1, F2, F3 and F4 extend throughout the entire reservoir field. The fine grid regions thereby introduce equations and associated unknowns throughout the entire field (e.g., beyond the boundaries of the fractures). Accordingly, the computational requirements for solving the reservoir model with the fractures increases.

Figure 3:
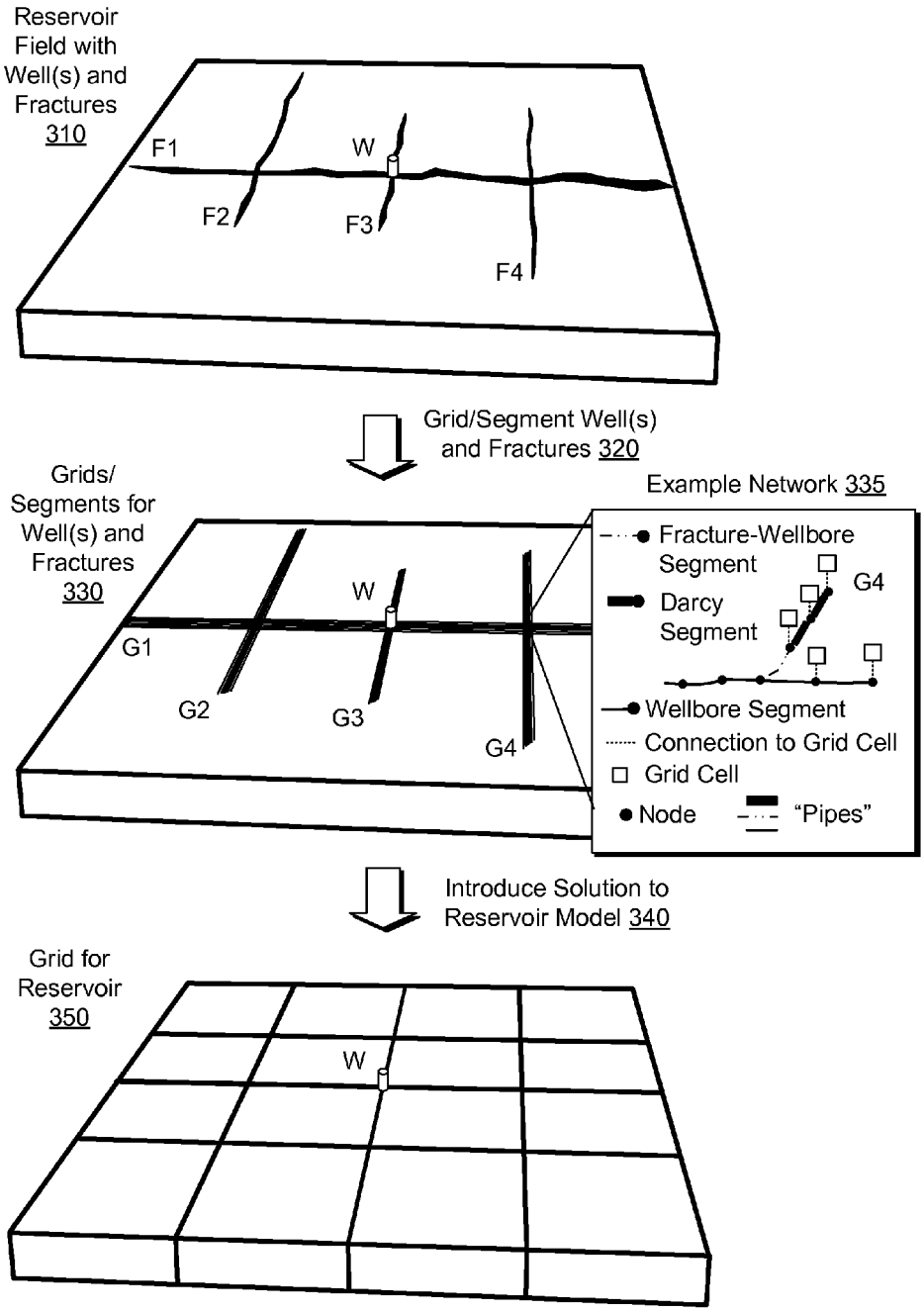
FIG. 3 illustrates an example of a reservoir field with a well and fractures, grids for modeling the well and fractures and another grid for a reservoir model.

FIG. 3 shows an example of a reservoir field 310 that includes one or more wells and fractures F1, F2, F3 and F4 in a formation. As described herein, an approach can include gridding or segmenting 320 a field to account for wells and fractures to generate a network (e.g., of segments) for wells and fractures 330, where such a network may include connections to a formation (e.g., a grid cell of a formation per a reservoir model). FIG. 3 shows an example network 335 that includes various fracture-wellbore segments, fracture or Darcy segments (e.g., porous media segments), wellbore segments, connections and grid cells. In the example network 335, the grid cells may be conventional grid cells of a reservoir model such that fractures and porous flows are accounted for by segments of a well-fracture model. As shown, the example fracture network 335 includes node and pipe segments, for example, where a node may be a juncture for two or more pipes. For example, a segment can include a node and a pipe that connects the segment to a neighboring segment's node towards a wellhead.

A well-fracture model approach may include solving systems of equations associated with one or more networks and introducing a solution 340 to a reservoir grid model 350. As shown in the example of FIG. 3, the reservoir grid model 350 may have a grid spacing (e.g., for a finite difference or other type of model) that is not restricted by the physical dimensions of the fractures F1, F2, F3 and F4. Accordingly, in the example of FIG. 3, the computational requirements for the reservoir grid model 350 are not impacted by any demands for a finer grid spacing.

Figure 4:
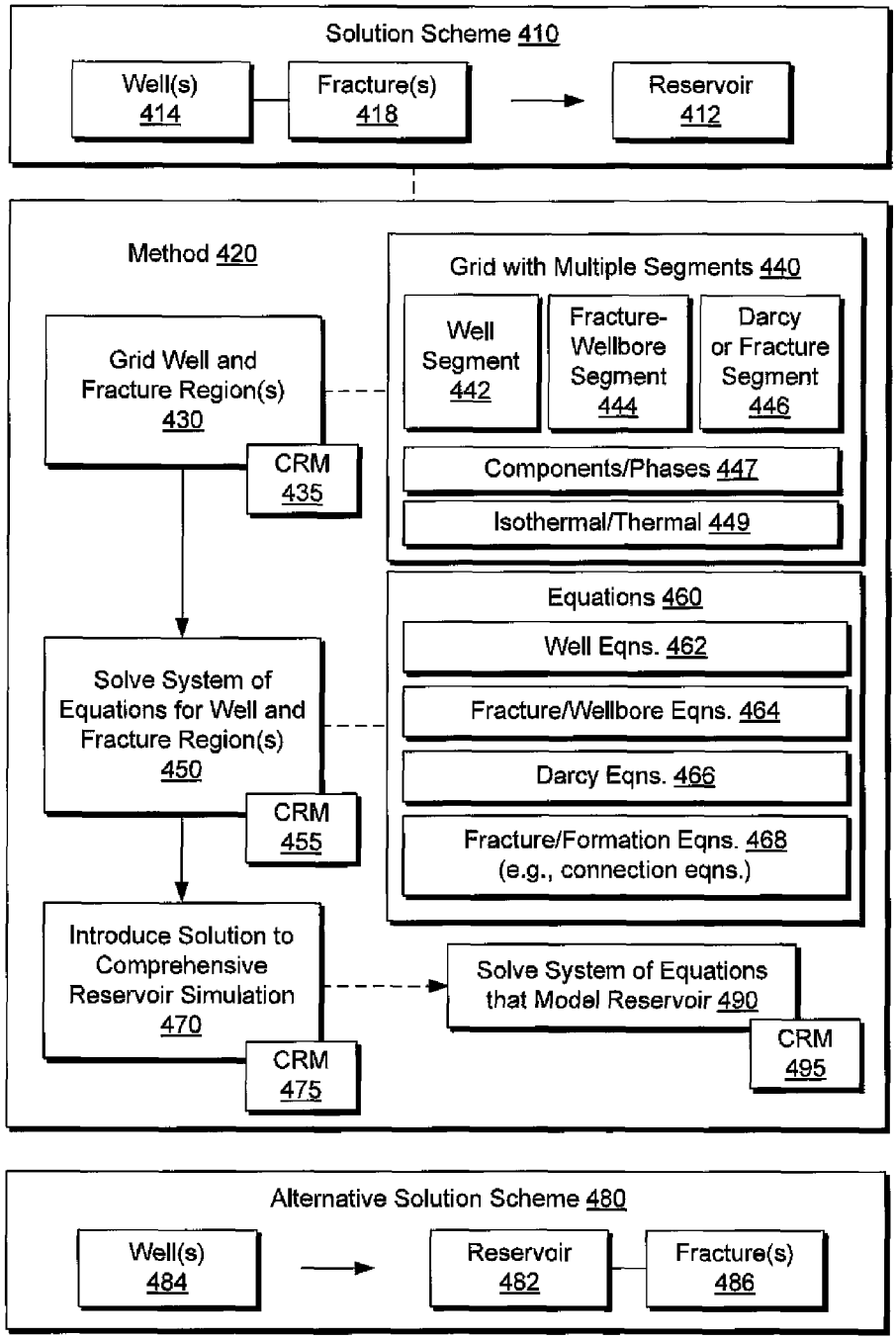
FIG. 4 illustrates examples of a solution scheme, a method associated with the solution scheme and an alternative solution scheme.

FIG. 4 shows examples of a solution scheme 410, a method 420 and an alternative solution scheme 480. The solution scheme 410 includes providing solution results for a well-fracture model to a reservoir model 412 where the well-fracture model associates one or more wells 414 with one or more fractures 418. The alternative solution scheme 480 includes providing solution results for a well model 484 to a model that models a reservoir 482 with one or more fractures 486 (e.g., a reservoir-fracture model).

In FIG. 4, the method 420 pertains to the solution scheme 410. In a grid block 430, the method 420 grids one or more well and fracture regions (e.g., to form one or more networks). For example, the block 430 may grid one or more regions with multiple segments 440 where each segment may be a well segment 442, a fracture-wellbore segment 444 or a Darcy (or fracture) segment 446, optionally characterized by components/phases 447 and/or as being isothermal/thermal 449. A well segment 442 may optionally be a conventional well segment, a fracture-wellbore segment 444 may be a segment that accounts for fracture-wellbore performance relations, and a Darcy segment 446 is generally a segment that models flow in a porous medium or porous media. The Darcy segment 446 represents a porous medium such as a fracture that may contain material such as a proppant or other material. In some instances, some information may be known a priori as to the characteristics of the fracture (e.g., especially for a well-characterized proppant).

As shown in the example of FIG. 4, the method 420 includes a solution block 450 for solving a system of equations for well and fracture regions. The system of equations 460 may include well equations 462, fracture/well equations 464, Darcy equations 466 and fracture/formation equations 468 (e.g., connection equations). As described herein, formulated equations for various phenomena in a well-fracture system may be solved simultaneously to convergence. A solution to such a system of equations may be by itself of use for field management or other management purposes.

In the example of FIG. 4, the method 420 includes an introduction block 470 for introducing a solution to a well-fracture model to a comprehensive reservoir simulation (e.g., in accord with the solution scheme 410). Further, the method 420 may include a solution block 490 for solving a system of equations that model a reservoir.

The method 420 also shows circuitry or computer-readable medium blocks 435, 455, 475 and 495, which may be physical components (e.g., actual circuitry, storage devices, combinations thereof, etc.) configured to perform actions of their corresponding method blocks 430, 450, 470 and 490.

As mentioned, FIG. 4 also shows an alternative solution scheme 480. The scheme 480 may optionally be implemented to benchmark or otherwise assess the scheme 410.

As described herein, one or more computer-readable media can include computer-executable instructions to instruct a computing system to iteratively solve a system of equations that model a wellbore and fracture network in a reservoir where the system of equations includes equations for multiphase flow in a porous medium, equations for multiphase flow between a fracture and a wellbore, and equations for multiphase flow between a formation of a reservoir and a fracture. As described herein, the equations for multiphase flow in a porous medium may include equations for Darcy phase molar flow rate.

As described herein, one or more computer-readable media may include instructions to instruct a computing system to iteratively solve individually multiple wellbore and fracture networks and to iteratively solve globally the multiple individual wellbore and fracture networks. A network may be modeled using segments, for example, well segments, Darcy segments and fracture-wellbore segments. Further, connection equations may be used for connecting a Darcy (or fracture) segment to a formation.

As described herein, a method can include iteratively solving a system of equations that model a wellbore and fracture network to provide a solution, introducing the solution as input to a system of equations that model a reservoir and iteratively solving the system of equations that model the reservoir. Such a method may include generating the wellbore and fracture network using segments. For example, such generating may include selecting fracture segments to represent at least a portion of a fracture and selecting a fracture-wellbore segment to represent inflow performance relations between a fracture and a wellbore.

FIGS. 5, 6, 7 and 8 present various sets of equations that may be used in a well-fracture model. Specifically, FIG. 5 shows Darcy flow equations, FIG. 6 shows alternative Darcy flow equations, FIG. 7 shows production (fracture-to-well) and injection (well-to-fracture) equations and FIG. 8 shows production (formation-to-fracture) and injection (fracture-to-formation) equations.

FIG. 5 shows Darcy equations 500 as including Darcy phase molar rate 510 and standard formulation component conservation equations 520. The Darcy equations 500 of FIG. 5 or FIG. 6 may be provided as the equations 466 of FIG. 4 and used for Darcy segments such as the Darcy segments 446 of FIG. 4.

In the equations 500, independent variables include:

$Z_i$,i∈components (global mole fractions, moles of component i/total moles)

P (pressure, e.g., gas)

H (total enthalpy per mole of mixture, e.g., for thermal simulations)

The Darcy phase molar flow rate equation 510 includes the following:

$$C_{darcy} = 0.006328, \text{ i.e. } 0.006328\frac{\text{ft}^3}{\text{D}} = \frac{\text{mD}\cdot\text{ft}^2\cdot psi}{cp\cdot\text{ft}}$$

$K_{frac}$=fracture permeability in mD

A=bulk cross sectional area $K_{r_{ph}}$=phase relative permeability $\mu_{ph}$=phase viscosity $$\delta P_{ph}=P_{outlet}-P_{seg}+\rho_{ph}\cdot mw_{ph}\cdot g\cdot dh$$

g=gravitational constant $mw_{ph}$=phase molecular weight dh=depth difference between outlet and segment nodes A so-called standard formulation of the component conservation equations 520 includes:

$$m_{c,ph}=G_{ph}\cdot\rho_{ph,upstream}\cdot x_{c,ph,upstream}$$

$\rho_{ph,upstream}$=upstream molar density of phase ph $x_{c,ph,upstream}$=upstream mole fraction of component c in phase ph $m_{c,k}$=flow of component c in connection k from the formation $m_{c,ph,s}=m_{c,ph}$ in all inlet segments $M_c^{t+\Delta t}$=total component c in this segment at the latest time t+Δt $M_c^t$=total amount of component c in this segment at time t FIG. 6 shows a so-called diagonal formulation of the conservation equations 530. The diagonal formulation can have different convergence properties when compared to the standard. In particular, the Jacobian matrix of the diagonal formulation is more diagonally dominant in the component equations and the global component mole fractions often converge more quickly than the pressure and total molar rate variables. The diagonal formulation can provide a reduction in the number of Newton iterations to converge a well model in some cases compared to the standard formulation where convergence tends to be more even across all variables.

In FIG. 6, the equations 530 include total molar flow rates in a segment pipe and in all connecting segments, a global mole fractions equation 534 (e.g., residual equation) and total molar balance equation 538 (see also $$\frac{\Delta M_c}{\Delta t}$$

of FIG. 5).

In FIG. 6, $M_T^{pipe}$ equals the total molar flow rate in the segment pipe and $M_{T,s}$ equals the total molar flow rate in all connecting segments s. In the global mole fractions equation 534:

$$m_{c,ph,s} = m_{c,ph} \text{ in some or all inlet segments}$$

$$\sum_{ph,s}^{prod} m_{c,ph,s} = \text{sum of all component } c \text{ in phase flows flowing toward the Darcy segment}$$

$$\sum_{k}^{prod} m_{c,k} = \text{sum over all connections of component } c \text{ producing (flowing into the segment)}$$

$$M_T^t = \text{total moles in this segment at time } t$$

FIG. 7 shows a production (fracture-to-well) equation 710 and an injection (well-to-fracture) equation 720. These equations may be provided as the equations 464 of FIG. 4 and be used to model fracture-wellbore segments such as the fracture-wellbore segments 444 of FIG. 4.

In the production equation 710 of FIG. 7:

$q_{ph,fw}$=volumetric flow rate of phase ph in fracture or Darcy segment into the well $T_{fw}$=fracture connection transmissibility factor $k_{r_{ph,f}}$=phase relative permeability in the fracture or Darcy segment $\mu_{ph,f}$=phase viscosity in the fracture or Darcy segment $P_f$=pressure in the fracture or Darcy segment $P_w$=pressure in the well at the connection k depth $H_{fw}$=pressure head between the Darcy segment node and the well connection depth As described herein, in a particular implementation, segments for producing flow can have almost the same variable set as that described with respect to FIGS. 5 and 6, with the exception that the phase volume flow rates are used instead of the phase molar rates:

$V_{ph}$, ph=o,g,w, . . . (phase volume flow rate, phase volume/D) for example, with the same independent variables:

$Z_i$,i∈components (global mole fractions, moles of component i/total moles)

P (pressure, e.g., gas)

H (total enthalpy per mole of mixture, e.g., for thermal simulations)

As described herein, in a particular approach, conservation law equations 520 and 534 can be the same while equation 538 can be thought of as the sum over components of equation 520.

As to the equation 720 of FIG. 7, the parameter $S_{ph,w}$ is the phase saturation in the well. For such segments, independent variables can be the same as described above for producing flow from fracture to well. For both injecting and producing flows from fracture-to-well, there are several expressions for the well-to-fracture transmissibility $T_{fw}$.

FIG. 8 shows a production (formation-to-fracture) equation 810 and an injection (fracture-to-formation) equation 820. Such equations may be used as the fracture/formation equations 468 of FIG. 4 (e.g., connection equations). With respect to modeling flow between a formation and a fracture, connection equations may have a form similar to those for modeling flow between a formation and a well. For example, for each connection k of a fracture (Darcy) segment to a formation, producing flow can be modelled by equation 810 where:

$q_{ph,k}$=volumetric flow rate of phase ph in connection k at reservoir conditions $T_{fk}$=fracture to formation connection k transmissibility factor $k_{r\ ph,k}$=phase relative permeability at the connection $\mu_{ph,k}$=phase viscosity at the connection $P_k$=pressure, defined at a "pressure equivalent length", in a grid block containing the fracture or Darcy segment $P_{seg}$=pressure in the Darcy segment $H_{fk}$=pressure head between a connecting grid block and a Darcy segment node As to equation 820 for injection flow from a fracture to a formation, $S_{phf}$ is the phase saturation in the fracture. Equation 820 can be a standard outflow performance relation for injecting connections in a well model. As described herein, equation 820 can differ in character with respect to the aforementioned Darcy phase molar flow rate equation (see, e.g., equation 510 of FIG. 5), which assumes the phases are connected (in some fashion). Accordingly, in one aspect a modelling approach does not necessarily require follow Darcy's law for injecting flow from fracture to formation.

Equations 810 and 820 of FIG. 8 both include a transmissibility factor. In the example of FIG. 8, the fracture to formation transmissibility $T_{fk}$ at connection k in equations 810 and 820 may be expressed as:

$$T_{fk} = \frac{cKh}{\frac{d_o}{d_f} + S}$$

In the foregoing transmissibility expression, factors or parameters may be:

c=a unit conversion factor

Kh=the effective permeability (e.g., harmonic average of fracture and formation permeability) times the net thickness of the connection $d_o$=a "pressure equivalent length" for flow from a thin fracture to formation S=a skin factor that represents the effect of formation damage around a fracture (e.g., due to acidizing, frac fluid leakoff, etc.)

In a modelling approach for flow to or from a formation, the length $d_o$ may be defined as the distance away from the fracture into the formation at which the local pressure is equal to the nodal average pressure of a block (e.g., a grid block of a reservoir model). For situations involving radial flow from a wellbore to a formation, the length may be obtained from a Peaceman formula. For flow away from a fracture, pressure contours presented by Prats (Prats M., 1961. "Effect of Vertical Fractures on Reservoir Behavior—Incompressible Fluid Case. SPE 1575-G and Society of Petroleum Engineers Journal, 106-118, June, 1961) or others may be of assistance in determining this length. Further, an approach somewhat akin to Prats may be relied on for expressing transmissibility.

An alternative approach to expressing transmissibility may be as follows:

$$T_{fk}=C_{darcy}\cdot Kh\cdot l_s/d_o$$

In the foregoing alternative transmissibility expression, $l_s$ is a Darcy segment length, which allows inflow performance relation equations 810 and 820 to retain some of the Darcy flow characteristics expressed in the Darcy phase molar flow rate equation 510 of FIG. 5.

As described herein, a modelling approach that relies on equations 810 and 820 may involve no further implementation in a well because the equations 810 and 820 may already be part of a standard well model that calculates well to reservoir grid cell connections. However, various approaches may further define a transmissibility factor as including a "pressure equivalent distance" for flow from formation to a fracture.

Figure 9:
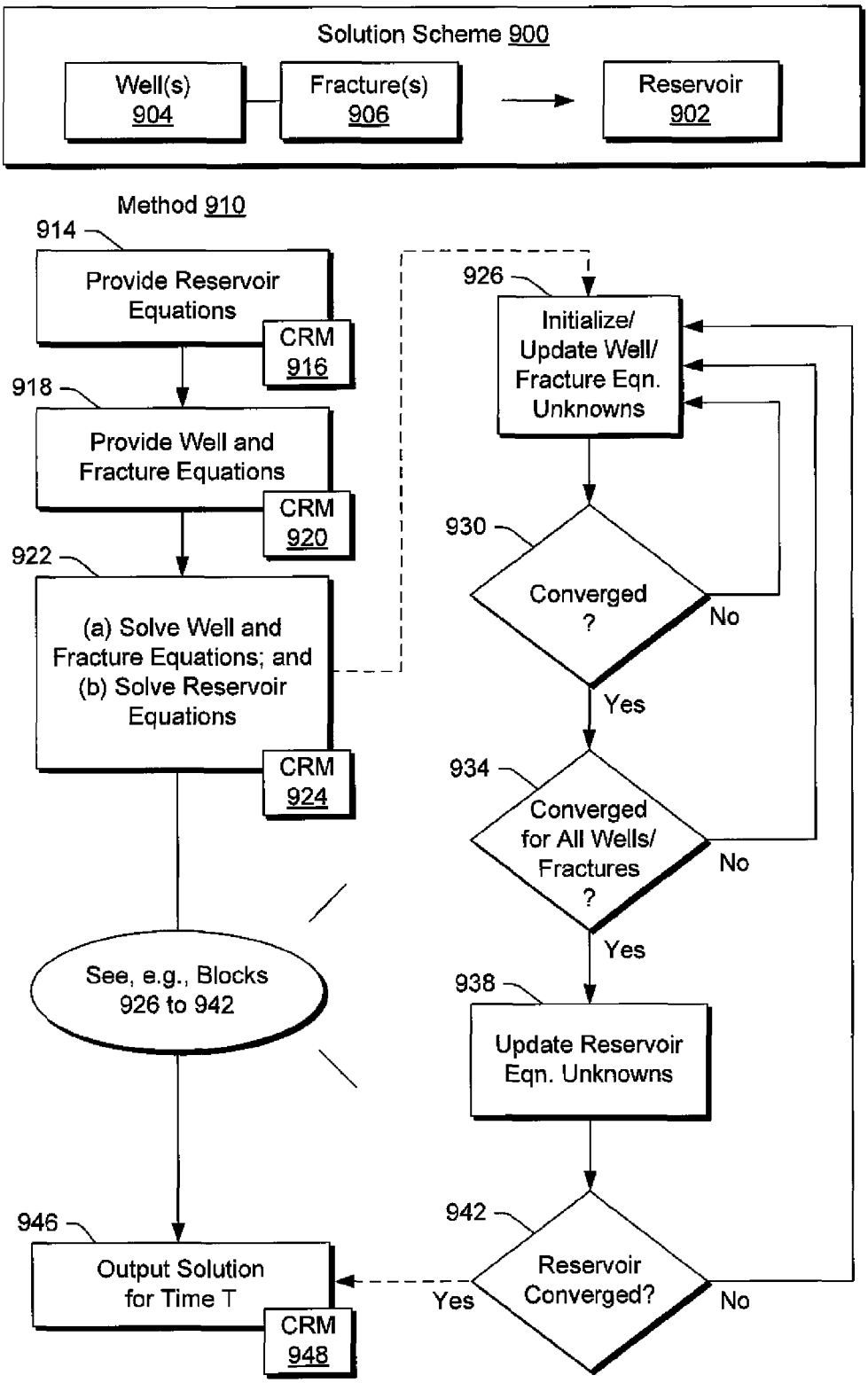
FIG. 9 illustrates examples of a solution scheme and an associated method for solving a system of well and fracture equations (e.g., a well-fracture model) in conjunction with a reservoir model.

FIG. 9 shows examples of a solution scheme 900 and a method 910. The solution scheme 900 includes providing a well-fracture model that models one or more wells 904 and one or more fractures 906, for example, as a network or networks. The scheme 900 provides for solving the well-fracture model and introducing the result to a model that models a reservoir 902.

In the examples of FIG. 9, a set of well equations and a set of fracture equations can be solved together and independently of a set of reservoir grid cell equations for each nonlinear iteration of a combined system of reservoir, well and fracture equations. From a reservoir grid solution viewpoint, such an approach has the effect of solving the reservoir system given a locally converged solution of at least one well-fracture system and optionally all well-fracture systems associated with a reservoir.

The method 910 includes a provision block 914 that provides reservoir equations and a provision block 918 that provides well and fracture equations. A solution block 922 includes (a) solving the well and fracture equations followed by (b) solving reservoir equations. An example of an approach for performing various actions of block 922 is presented with respect to blocks 926 to 942. Thereafter, the method 910 provides, per an output block 946, a solution for a time T.

In the example of FIG. 9, the solution block 922 can implement nested loops that act to converge solutions to various equations. An outer loop acts to converge a solution to reservoir equations via a decision block 942, an inner loop acts to converge a solution to equations for all wells and fractures via a decision block 934, and an innermost loop acts to converge a solution to equations for a particular well-fracture system via a decision block 930. Accordingly, the blocks 926 to 942 can begin with initialization of well and fracture equations per block 926 (e.g., optionally based on output from a reservoir model simulator), followed by converging solutions for each particular well-fracture system and then globally converging the solutions for all well-fracture systems. After convergence of all well-fracture systems, an update block 938 may update unknowns for reservoir equations (e.g., independent variables). A simulator may solve the reservoir equations by a technique that iterates values of the unknowns until convergence. Once converged, the result may be output per the output block 946. Such a result aims to include a global solution for a reservoir including all of its associated well-fracture systems.

FIG. 9 also shows various computer-readable media blocks (CRM) 916, 920, 924 and 948, which correspond to method blocks 914, 918, 922 and 946, respectively. While blocks are shown individually, a single computer-readable may include instructions of blocks 916, 920, 924 and 948.

Figure 10:
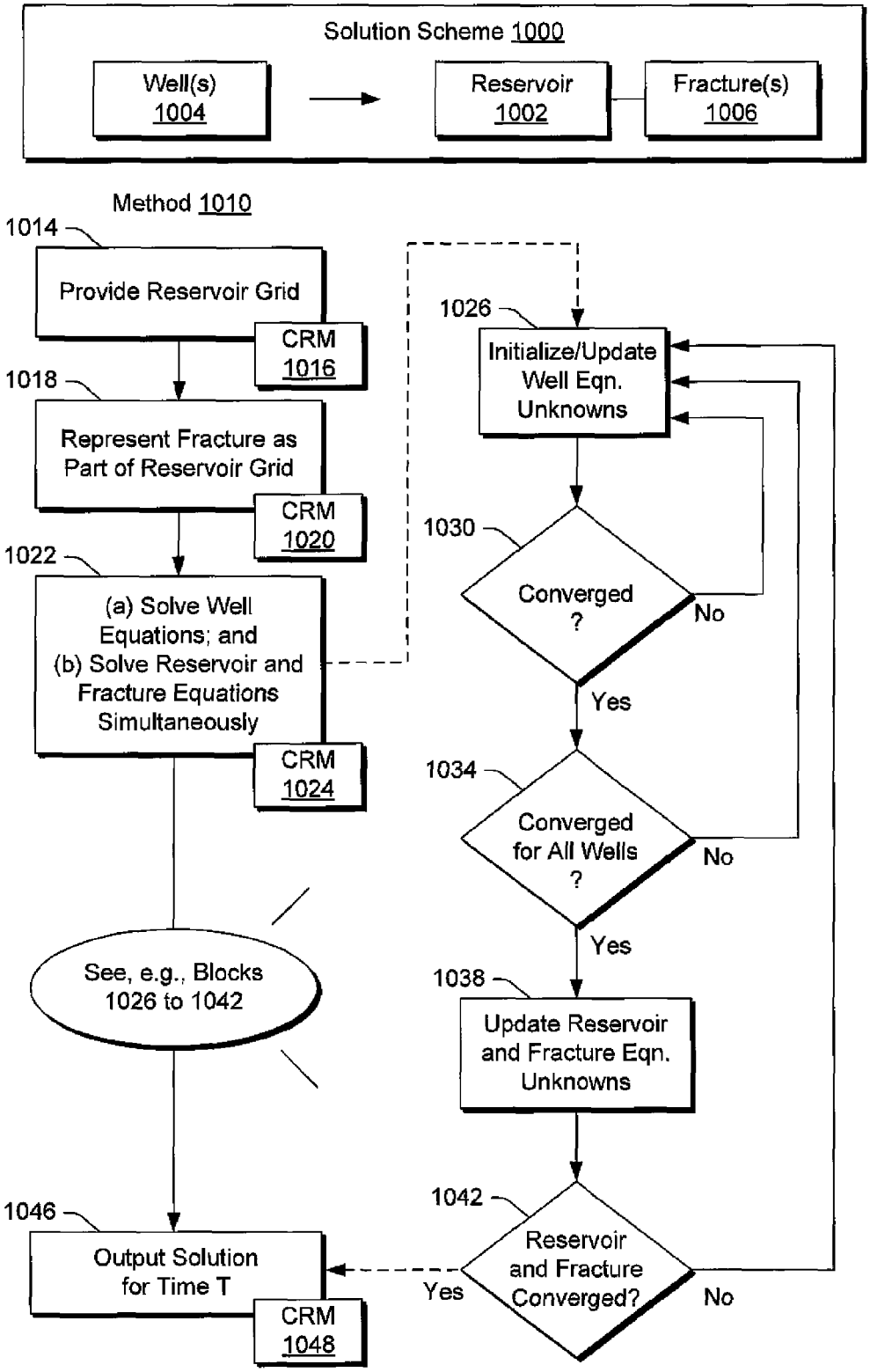
FIG. 10 illustrates examples of a solution scheme and an associated method for solving a system of well equations (e.g., a well model) in conjunction with a reservoir-fracture model.

For purposes of comparison, FIG. 10 shows an alternative solution scheme 1000 along with a method 1010. The scheme 1000 provides a solution to a model for wells 1004 as input to a model for a reservoir 1002 with fractures 1006.

The method 1010 includes a provision block 1014 that provides a reservoir grid with reservoir equations and a provision block 1018 that represents fractures as part of a reservoir grid with associated fracture equations. A solution block 1022 includes (a) solving well model equations followed by (b) solving reservoir and fracture equations simultaneously. An example of an approach for performing various actions of block 1022 is presented with respect to blocks 1026 to 1042. Thereafter, the method 1010 provides, per an output block 1046, a solution for a time T.

In the example of FIG. 10, the solution block 1022 can implement nested loops that act to converge solutions to various equations. An outer loop acts to converge a solution to reservoir and fracture equations via a decision block 1042, an inner loop acts to converge a solution to equations for all wells via a decision block 1034, and an innermost loop acts to converge a solution to equations for a particular well via a decision block 1030. Accordingly, the blocks 1026 to 1042 can begin with initialization of well model equations per block 1026 (e.g., optionally based on output from a reservoir and fracture model simulator), follow by converging solutions for each particular well and then globally converging the solutions for all wells. After convergence of all wells, an update block 1038 may update unknowns for reservoir and fracture equations. A simulator may solve the reservoir and fracture equations by a technique that iterates values of the unknowns until convergence. Once converged, the result may be output per the output block 1046. Such a result aims to include a global solution for a reservoir that has fractures including all of its associated wells.

FIG. 10 also shows various computer-readable media blocks (CRM) 1016, 1020, 1024 and 1048, which correspond to method blocks 1014, 1018, 1022 and 1046, respectively. While blocks are shown individually, a single computer-readable may include instructions of blocks 1016, 1020, 1024 and 1048.

In comparing the method 910 to the method 1010, while at first glance the method 910 looks like more work to solve the same coupled equations, in various situations, advantages may arise, for example: there can be a more robust solution to the combined set of well and fracture equations; the convergence performance of the outer system of reservoir grid equations may be enhanced by not having to deal with large changes associated with the tightly coupled flows; and the reliability of the solution procedure for the overall system of equations and performance may also be enhanced. Further, for example, consider that the method 910 does not have the tiny reservoir grid blocks that model the fractures that the method 1010 has. Therefore the solution to 910 may be more robust than 1010 because it is handling the fluid flow physics (i.e., time and space scales including change in time and space of physical properties such as densities, saturations, etc.) in a more uniform fashion. Uniform fashion here means that the changes in space and time of physical properties in the wells and fractures is more closely aligned than the changes in space and time of physical properties in the reservoir.

Figure 11:
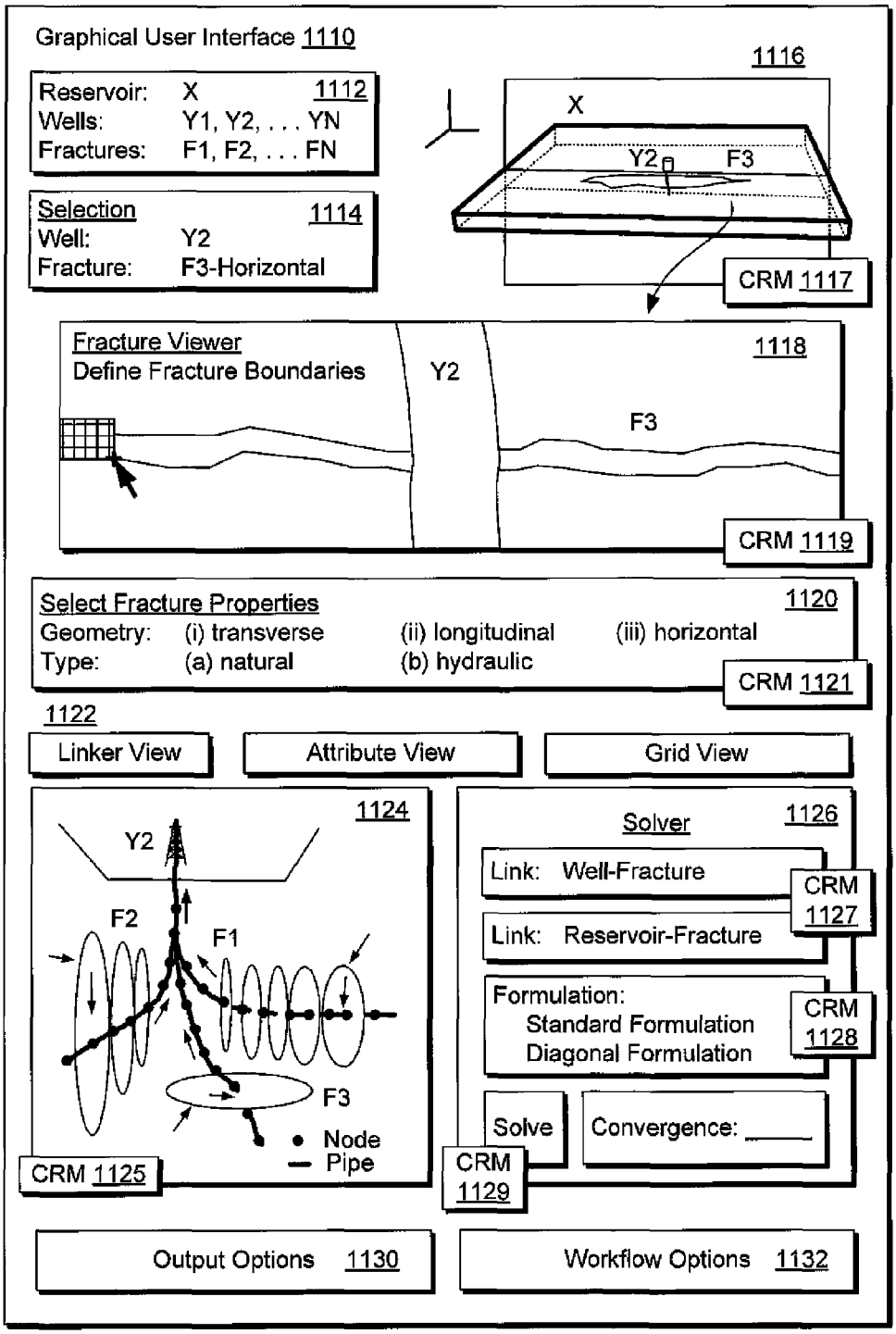
FIG. 11 illustrates an example computing device and method.

FIG. 11 shows a graphical user interface (GUI) 1110 that may be implemented using one or more computing devices and rendered to a display, locally or remotely. The GUI 1110 may include one or more of the graphics 1112, 1114, 1116, 1118, 1120, 1122, 1124, 1126, 1130 and 1132. The graphic 1112 provides information pertaining to a reservoir such as number of wells and number of fractures. The graphic 1114 provides information as to a selected one or more wells, one or more fractures, etc.

The graphic 1116 provides a perspective view of a field that includes selected features such as wells and fractures. The viewer graphic 1118 provide for defining boundaries of a fracture, for example, to grid or segment a fracture for purposes of modeling (e.g., whether as part of a well-fracture model or a reservoir-fracture model). The graphic 1120 allows provides for selection of, display of, etc., fracture properties.

The series of graphics 1122 may be controls that allow a user to implement a linker to link features in a reservoir, access and display attributes of a reservoir, or access and display a grid associated with a region of a reservoir.

In the example of FIG. 11, the graphic 1124 may display a perspective view of a network or networks that include one or more fractures. The solver graphic 1126 may allow a user to select various solver options and to view information indicative of whether or not a solution is converging (e.g., one or more errors associated with non-final solutions to equations). As shown, segments form a network that includes nodes and pipes.

The example GUI 1110 includes the output options 1130 graphic control and the workflow options graphic control 1132. Such options may allow a user to direct solutions or other information associated with a well-fracture-reservoir system to particular destinations for any of a variety of purposes. For example, for a shale gas reservoir with hydraulic fractures, hydraulic fracture workflows in the ECLIPSE® compositional simulator may allow one to gain time-dependent hydraulic-fracture property support for diffusivity, transmissibility, permeability, and pore volume. Output information may provide for perform flexible restarts using various properties.

As described herein, various GUIs may be implemented, in part, via computer-readable medium blocks such as 1117, 1119, 1121, 1127, 1128 and 1129, which may be physical components (e.g., actual circuitry, storage devices, combinations thereof, etc.) configured to perform actions of their corresponding GUIs.

As described herein one or more computer-readable media can include computer-executable instructions to instruct a computing system to: render a graphical representation of a reservoir to a display (see, e.g., the CRM 1117 of FIG. 11); receive input to indicate a fracture in the reservoir (see, e.g., the CRM 1119 of FIG. 11); receive input to link a fracture to a wellbore in the reservoir (see, e.g., the CRM 1127 of FIG. 11); and generate a system of equations that model a wellbore and fracture network in the reservoir (see, e.g., the CRM 1128 of FIG. 11). Such one or more computer-readable media may further include instructions to instruct a computing system to iteratively solve the system of equations for the wellbore and fracture network (see, e.g., the CRM 1129 of FIG. 11). As described herein, one or more computer-readable media may include instructions to instruct a computing system to represent a fracture using fracture segments, to represent a connection from a fracture segment to a grid cell of a model of the reservoir and to represent a link between a fracture and a wellbore using a fracture-wellbore segment. As described herein, one or more computer-readable media may include instructions to iteratively solve a system of equations for a wellbore and fracture network and to iteratively and globally solve a system of equations for multiple wellbore and fracture networks. As described herein, a computer-readable medium may optionally be a storage device (e.g., a hard drive, a memory chip, an optical device, etc.).

Figure 12:
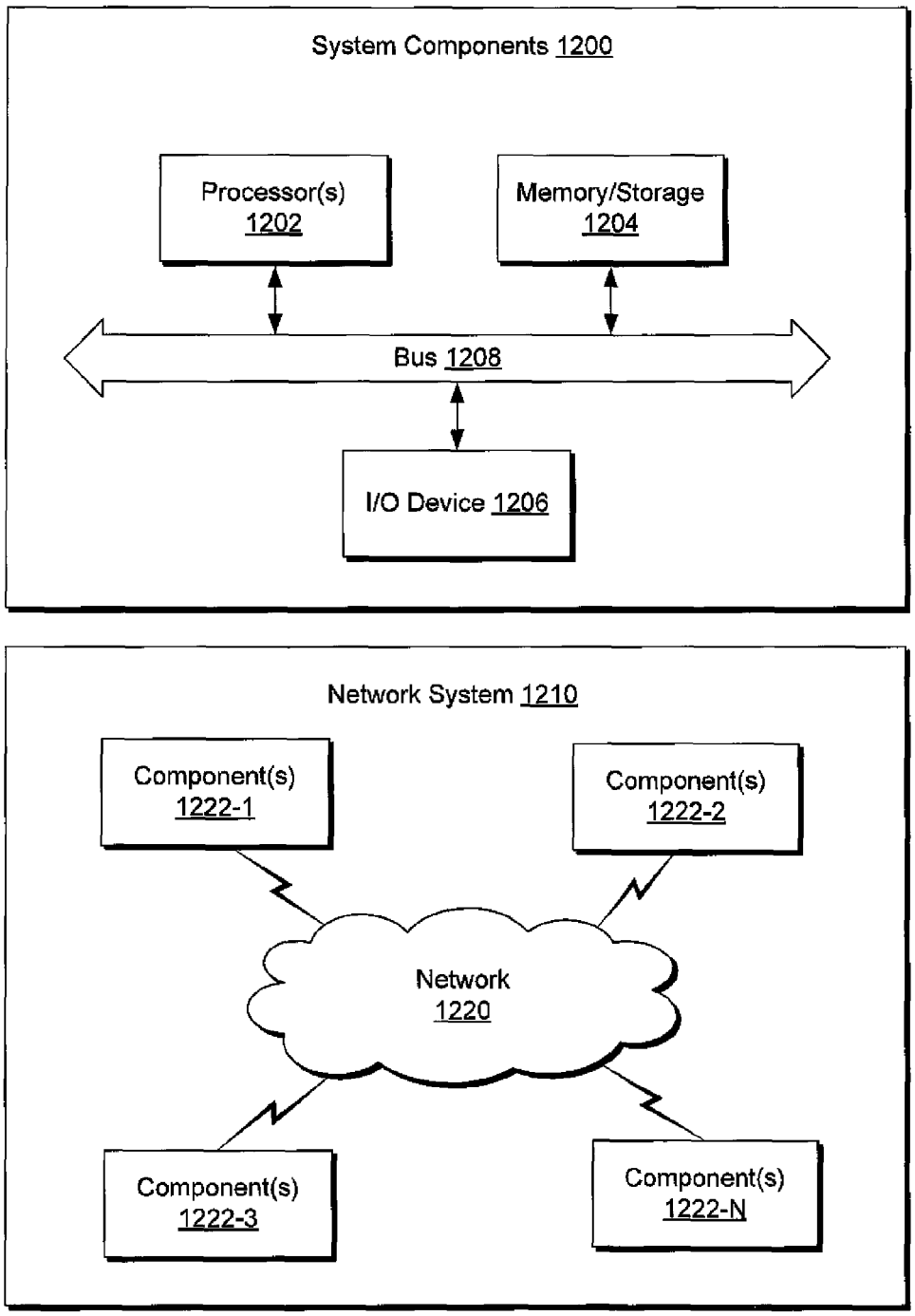
FIG. 12 illustrates example components of a system and a networked system.

FIG. 12 shows components of a computing system 1200 and a networked system 1210. The system 1200 includes one or more processors 1202, memory and/or storage components 1204, one or more input and/or output devices 1206 and a bus 1208. As described herein, instructions may be stored in one or more computer-readable media (e.g., memory/storage components 1204). Such instructions may be read by one or more processors (e.g., the processor(s) 1202) via a communication bus (e.g., the bus 1208), which may be wired or wireless. The one or more processors may execute such instructions to implement (wholly or in part) one or more virtual sensors (e.g., as part of a method). A user may view output from and interact with a process via an I/O device (e.g., the device 1206).

As described herein, components may be distributed, such as in the network system 1210. The network system 1210 includes components 1222-1, 1222-2, 1222-3, . . . 1222-N. For example, the components 1222-1 may include the processor(s) 1202 while the component(s) 1222-3 may include memory accessible by the processor(s) 1202. Further, the component(s) 1202-2 may include an I/O device for display and optionally interaction with a method. The network may be or include the Internet, an intranet, a cellular network, a satellite network, etc.

CONCLUSION

Although various methods, devices, systems, etc., have been described in language specific to structural features and/or methodological acts, it is to be understood that the subject matter defined in the appended claims is not necessarily limited to the specific features or acts described. Rather, the specific features and acts are disclosed as examples of forms of implementing the claimed methods, devices, systems, etc.

The invention claimed is:

1. One or more computer-readable non-transitory media comprising computer-executable instructions to instruct a computing system to:

iteratively solve a system of equations that model a wellbore and fracture network of node and pipe segments in a reservoir to provide a solution wherein the node and pipe segments comprise a pipe of a node and pipe fracture segment mathematically coupled to a node of a fracture-wellbore segment and comprise a pipe of the fracture-wellbore segment mathematically coupled to a node of a node and pipe well segment and wherein the system of equations comprises well segment equations for multiphase flow in a wellbore of the wellbore and fracture network, fracture segment equations for multiphase flow in a porous medium of a fracture of the wellbore and fracture network, fracture-wellbore segment equations for multiphase flow between the fracture and the wellbore, and formation connection equations for multiphase flow between a formation of the reservoir and the fracture; and output the solution to a reservoir simulator configured to simulate the reservoir.

2. The one or more computer-readable non-transitory media of claim 1 wherein the equations for multiphase flow in a porous medium comprise equations for Darcy phase molar flow rate.

3. The one or more computer-readable non-transitory media of claim 1 further comprising equations that model enthalpy.

4. The one or more computer-readable non-transitory media of claim 1 wherein the equations for multiphase flow between the fracture and the wellbore comprise producing flow equations and injecting flow equations.

5. The one or more computer-readable non-transitory media of claim 1 wherein the equations for multiphase flow between the formation of the reservoir and the fracture comprise producing flow equations and injecting flow equations.

6. The one or more computer-readable non-transitory media of claim 1 further comprising instructions to instruct a computing system to iteratively solve individually multiple wellbore and fracture networks and to iteratively solve globally the multiple individual wellbore and fracture networks.

7. A method comprising:

iteratively solving a system of equations that model a wellbore and fracture network of node and pipe segments to provide a solution wherein the node and pipe segments comprise a pipe of a node and pipe fracture segment mathematically coupled to a node of a fracture-wellbore segment and comprise a pipe of the fracture-wellbore segment mathematically coupled to a node of a node and pipe well segment and wherein the system of equations comprises well segment equations for multiphase flow in a wellbore of the wellbore and fracture network, fracture segment equations for multiphase flow in a porous medium of a fracture of the wellbore and fracture network, fracture-wellbore segment equations for multiphase flow between the fracture and the wellbore, and formation connection equations for multiphase flow between a formation of a reservoir and the fracture;

introducing the solution as input to a system of equations that model the reservoir; and iteratively solving the system of equations that model the reservoir.

8. The method of claim 7 further comprising generating the wellbore and fracture network using segments.

9. The method of claim 7 wherein the generating comprises selecting fracture segments to represent at least a portion of the fracture and selecting a fracture-wellbore segment to represent inflow performance relations between the fracture and the wellbore.

10. One or more computer-readable non-transitory media comprising computer-executable instructions to instruct a computing system to:

render a graphical representation of a reservoir to a display;

receive input to indicate a fracture in the reservoir;

receive input to link the fracture to a wellbore in the reservoir;

generate a system of equations that model a wellbore and fracture network of node and pipe segments in the reservoir wherein the node and pipe segments comprise a pipe of a node and pipe fracture segment mathematically coupled to a node of a fracture-wellbore segment and comprise a pipe of the fracture-wellbore segment mathematically coupled to a node of a node and pipe well segment and wherein the system of equations comprises well segment equations for multiphase flow in the wellbore, fracture segment equations for multiphase flow in a porous medium of the fracture, fracture-wellbore segment equations for multiphase flow between the fracture and the wellbore, and formation connection equations for multiphase flow between a formation of the reservoir and the fracture;

iteratively solve the system of equations for the wellbore and fracture network; and iteratively and globally solve a system of equations for multiple wellbore and fracture networks.

11. The one or more computer-readable non-transitory media of claim 10 further comprising computer-executable instructions to instruct a computing system to represent the fracture using fracture segments.

12. The one or more computer-readable non-transitory media of claim 11 further comprising computer-executable instructions to instruct a computing system to represent a connection from a fracture segment to a grid cell of a model of the reservoir.

13. The one or more computer-readable non-transitory media of claim 10 further comprising computer-executable instructions to instruct a computing system to represent a link between the fracture and the wellbore using a fracture-wellbore segment.

* * * * *